US012012672B2

(12) United States Patent
Sprecher

(10) Patent No.: US 12,012,672 B2
(45) Date of Patent: Jun. 18, 2024

(54) OPEN-END SPINNING MACHINE, AND METHOD AND CONTROL DEVICE FOR OPERATING AN OPEN-END SPINNING MACHINE OF THIS TYPE

(71) Applicant: Saurer Spinning Solutions Gmbh & Co. KG, Uebach-Palenberg (DE)

(72) Inventor: Jonathan Sprecher, Aachen (DE)

(73) Assignee: Saurer Spinning Solutions Gmbh & Co. KG, Übach-Palenberg (DE)

( * ) Notice: Subject to any disclaimer, the term of this patent is extended or adjusted under 35 U.S.C. 154(b) by 129 days.

(21) Appl. No.: 17/772,884

(22) PCT Filed: Oct. 29, 2020

(86) PCT No.: PCT/EP2020/080339
§ 371 (c)(1),
(2) Date: Apr. 28, 2022

(87) PCT Pub. No.: WO2021/083985
PCT Pub. Date: May 6, 2021

(65) Prior Publication Data

US 2022/0403560 A1 Dec. 22, 2022

(30) Foreign Application Priority Data

Oct. 31, 2019 (DE) ..... 102019129499.1

(51) Int. Cl.
*D01H 4/48* (2006.01)
*D01H 4/08* (2006.01)
(Continued)

(52) U.S. Cl.
CPC ..... *D01H 4/48* (2013.01); *D01H 4/08* (2013.01); *D01H 4/50* (2013.01); *D01H 15/00* (2013.01)

(58) Field of Classification Search
CPC .. D01H 4/42; D01H 4/44; D01H 4/48; D01H 4/50; D01H 15/013; B65H 51/20; B65H 51/205; B65H 59/005; B65H 2701/31
See application file for complete search history.

(56) References Cited

U.S. PATENT DOCUMENTS

2003/0029153 A1* 2/2003 Straaten ..... D01H 4/50 57/263
2019/0177110 A1* 6/2019 Pilar ..... D01H 4/48
2020/0310388 A1* 10/2020 Pilar ..... D01H 13/104

FOREIGN PATENT DOCUMENTS

DE 2725105 C3 * 7/1994 ..... D01H 4/48
DE 19926492 A1 4/2000
(Continued)

OTHER PUBLICATIONS

International Search Report and Written Opinion, PCT/EP2020/080339, dated Feb. 4, 2021, 12 pages.
(Continued)

*Primary Examiner* — Shaun R Hurley
(74) *Attorney, Agent, or Firm* — Nelson Mullins Riley & Scarborough LLP

(57) ABSTRACT

An open-end spinning machine having a plurality of workstations, each workstation has a spinning apparatus for producing a thread, a thread draw-off device for drawing off the thread from the spinning apparatus, a storage nozzle, a winding apparatus for producing a cross-wound bobbin, and a suction nozzle, to which negative pressure can be applied. The open-end spinning machine is equipped with at least one service unit, serving a plurality of the workstations and has an auxiliary-thread delivery device for delivering an auxiliary thread and an auxiliary-thread draw-off, which are used in a piecing process at a workstation to be served. The auxiliary-thread draw-off can be operated in such a way that the auxiliary-thread draw-off speed of the auxiliary-thread
(Continued)

draw-off for drawing off the pieced auxiliary thread has a speed offset, which takes into account the thread draw-off speed of the thread draw-off device and at least one additional correction factor.

11 Claims, 2 Drawing Sheets

(51) Int. Cl.
*D01H 4/50* (2006.01)
*D01H 15/00* (2006.01)

(56) References Cited

FOREIGN PATENT DOCUMENTS

| | | | | | |
|---|---|---|---|---|---|
| DE | 10139072 | A1 | | 2/2003 | |
| DE | 10161014 | A1 | * | 6/2003 | ..... D01H 4/44 |
| DE | 102005022186 | A1 | | 11/2006 | |
| DE | 102005022187 | A1 | | 11/2006 | |
| DE | 102007056561 | A1 | | 2/2009 | |
| DE | 102008050340 | A1 | | 4/2010 | |
| DE | 102009030677 | A1 | | 12/2010 | |
| EP | 1156142 | B1 | | 4/2004 | |
| EP | 2267200 | A1 | | 12/2010 | |
| WO | WO-2008128596 | A1 | * | 10/2008 | ..... D01H 13/14 |

OTHER PUBLICATIONS

German Search Report of DE 102019129499.1, dated Oct. 31, 2019, 8 pages.

* cited by examiner

OPEN-END SPINNING MACHINE, AND METHOD AND CONTROL DEVICE FOR OPERATING AN OPEN-END SPINNING MACHINE OF THIS TYPE

CROSS-REFERENCE TO RELATED APPLICATIONS

This application claims priority from PCT International Patent Application No. PCT/EP2020/080339, filed Oct. 29, 2020, which claims priority from German National Patent Application No. 10 2019 129 499.1, filed Oct. 31, 2019, entitled "Offenend-Spinnmaschine sowie Verfahren and Steuereinrichtung zum Betreiben einer solchen Offenend-Spinnmaschine", the entire contents of which are incorporated herein by reference.

FIELD OF THE INVENTION

The present invention relates to an open-end spinning machine having a plurality of workstations, each of which has: —a spinning device for producing a thread; —a thread take-up device for taking up the thread from the spinning device; —an accumulator navel for temporarily storing the taken-up thread; —a winding device for producing a cross-wound package; and —a suction nozzle, which can be subjected to a vacuum, the open-end spinning machine being equipped with at least one service unit, which serves several of the workstations and which has an auxiliary thread delivery device for delivering an auxiliary thread and an auxiliary thread take-up, which are used during a piecing process at a workstation to be served, in particular in the course of a cross-wound package/empty tube change, and to a method for operating such an open-end spinning machine.

BACKGROUND OF THE INVENTION

In connection with open-end spinning machines, it has long since been known that such textile machines often have a plurality of workstations arranged side by side, which are generally of identical design and each equipped with a plurality of different working organs.

The workstations of such open-end spinning machines can each have an open-end spinning device designed as a rotor spinning device, the spinning rotor preferably being magnetically supported, as described for example in the publication EP 1 156 142 B1, or alternatively the workstations can each be equipped with an open-end spinning device which has an air-jet spinning device. Such air-jet spinning devices are described relatively thoroughly in the publication DE 199 26 492 A1 or the publication DE 2005 022 186 A1, for example.

Furthermore, the workstations of such open-end spinning machines are often designed as largely autonomous workstations, i.e. the workstations of such open-end spinning machines can piece themselves up automatically after a thread break. Preferably, each of the workstations has, for this purpose and in addition to a spinning device and a winding device, an accumulator navel for temporarily storing a produced thread and a suction nozzle, which is mounted, in particular pivotally mounted, between the spinning device and the winding device and which can be subjected to a vacuum.

Although such autonomous workstations can automatically piece themselves up after a thread break, open-end spinning machines equipped in this way are often also equipped with at least one service unit, which is used during a piecing process at a workstation to be served, in particular for cross-wound package/empty tube changes. This means that such service units intervene when a cross-wound package has reached a specified diameter at one of the workstations and must be exchanged for a new empty tube.

Such service units have also been known for a long time and, as described in great detail in the publication DE 101 39 072 A1 for example, usually have numerous different handling devices. Such service units have, for example, an auxiliary thread delivery device for providing an auxiliary thread required for piecing up a workstation in connection with a cross-wound package/empty tube change, a thread placing apparatus for fixing the newly pieced spinning thread on an empty tube held in a package cradle of the winding device of the workstation concerned, and an auxiliary thread take-up, which is used for taking up the newly pieced spinning thread and in particular for disposing of the piecing produced by means of the auxiliary thread.

The auxiliary thread delivery device often has what is referred to as a thread delivery pipe, which is mounted in an intermediate wall of the service unit such that the thread delivery pipe can rotate about a pivot axis and which can be positioned in a defined manner by means of a stepper motor. A reserve package is connected to the thread delivery pipe, for example via a rotary union and a pipe and/or hose system, which reserve package provides a required auxiliary thread. In the area of the pipe and/or hose system, a delivery unit is also arranged, which pulls the auxiliary thread off the reserve package, and a thread cutting device is installed, which cuts the auxiliary thread after its last transfer to the suction nozzle of the workstation, which suction nozzle is in particular pivotally mounted. The thread placing device of such service units is preferably designed as a pivot arm which can be moved from a rear rest position into the area of the winding device of the workstation and which has a head element having a plurality of different handling devices. The head element is equipped, for example, with a thread guide roller, a thread brake and a thread cutting device. Furthermore, the head element of the thread placing device can have an adapter plate opener, by means of which an adapter plate of the winding device can be acted upon in such a way that a gap is provided between the adapter plate and an end face of an empty tube held in the winding device.

In addition, such service units are usually equipped with an auxiliary thread take-up, which drives the auxiliary thread by frictional engagement, in particular during disposal of the auxiliary thread. According to the prior art, the take-up speed of this auxiliary thread take-up corresponds to the thread take-up speed of the thread take-up device of the workstation.

As already indicated above, such service units are preferably used when a cross-wound package has reached a specified diameter at a workstation of an open-end spinning machine and has to be exchanged for a new empty tube.

In such a case, the service unit is called to the relevant workstation, positions itself there and transfers the full cross-wound package from the package cradle of the workstation onto a cross-wound package transport device, which is arranged behind the winding devices and preferably runs the length of the machine, which cross-wound package transport device conveys the cross-wound package to a transfer station, which is usually arranged at a machine end. Then the service unit puts a new empty tube into the package cradle of the workstation.

Since a piecing thread is required for subsequently piecing up the workstation, but the inserted empty tube does not have any thread material that could be used as the piecing thread, the service unit provides what is referred to as the auxiliary thread. This means that the thread delivery pipe of the auxiliary thread delivery device swivels into a lower operating position and transfers the beginning of the auxiliary thread to a suction nozzle of the workstation, which suction nozzle is positioned in what is referred to as a thread transfer position, the suction nozzle being, in particular, pivotally mounted. The suction nozzle then swivels downwards and transfers the beginning of the auxiliary thread to a piecing tool arranged in the area of the spinning device, which piecing tool prepares the auxiliary thread for the piecing process. In the course of the swivelling process of the suction nozzle, the auxiliary thread was also threaded into a thread take-up device of the workstation.

Simultaneously or subsequently, the thread delivery pipe of the auxiliary thread delivery device swivels into an upper operating position and the thread placing device swivels toward the winding device of the workstation. During this movement, the auxiliary thread provided by the auxiliary thread delivery device, which auxiliary thread at this point in time is tensioned between the thread take-up device of the workstation and the upwardly swivelled thread delivery pipe, is transferred into the area of the winding device of the workstation by means of the handling devices arranged on the head element of the thread placing device of the service unit. This means that the tensioned auxiliary thread runs in the area of the winding device through a gap provided between an adapter plate of the winding device and the end face of the inserted empty tube.

Subsequently, the thread delivery pipe of the auxiliary thread delivery device swivels further in the clockwise direction and places the auxiliary thread into the auxiliary thread take-up of the service unit before the auxiliary thread is transferred again to the pivotally mounted suction nozzle which is again positioned in the thread transfer position. This is followed by the actual piecing process, which is known.

After the piecing process, the auxiliary thread now connected to the new spinning thread via what is referred to as a piecing is disposed of. This means that the auxiliary thread or the new spinning thread is taken up by the thread take-up device of the workstation and runs, guided by the handling elements of the thread placing device and acted on by the auxiliary thread take-up of the service unit, into the pivotally mounted suction nozzle of the workstation, which disposes of the auxiliary thread. Increased thread friction occurs during this process, in particular also due to the multiple deflection of the auxiliary thread or the new spinning thread in the area of the handling elements of the thread placing device, with the consequence that a thread loop forms between the thread take-up device of the workstation and the auxiliary thread take-up of the service unit, which thread loop must be temporarily stored by the accumulator navel of the workstation.

As soon as the piecing has passed the winding device, i.e. the area of the gap between an adapter plate and the empty tube, the new spinning thread is clamped by closing the gap and separated by the thread cutting device in a functionally appropriate manner. The empty tube is then rotated and the new winding process is thus started.

The spinning thread, which is further produced by the open-end spinning device during the clamping and cutting process and continuously taken up by the thread take-up device of the workstation, is likewise temporarily stored in the accumulator navel of the workstation.

A disadvantage of the known open-end spinning machines and the methods for operating these textile machines is that, both during the disposal of the auxiliary thread and during the clamping and cutting process of the new spinning thread, relatively large thread loops are formed, which have to be temporarily stored by the accumulator navel of the workstation. This means that, due to the often quite large quantities of thread that have to be temporarily stored in the accumulator navel of the workstation, problems often arise during the subsequent straightening out of the thread loops that have formed. This means that, for example, there is a risk that the thread loops located in the suction nozzle, which often extend into the machine-length vacuum duct of the open-end spinning machine, become entangled, with the result that either a thread break occurs or the spinning thread temporarily stored in the accumulator navel runs onto the empty tube with an undefined thread tension.

SUMMARY OF THE INVENTION

Proceeding from the aforementioned prior art, the problem addressed by the present invention is one of reducing or, better still, avoiding the risk of a thread break and/or uncontrolled entanglement of a thread loop, which is to be temporarily stored, in an accumulator navel of a workstation of an open-end spinning machine during a piecing process, in particular in the course of a cross-wound package/empty tube change.

This problem is solved according to a first device aspect by configuring the auxiliary thread take-up and enabling it to be operated in such a way that the auxiliary thread take-up speed of the auxiliary thread take-up for the take-up of the pieced auxiliary thread, preferably at the start of the take-up or from a defined point in time between the start of the take-up and an initiated interruption of the take-up of the pieced auxiliary thread, for example by clamping the auxiliary thread in the thread path upstream of the auxiliary thread take-up, has a speed offset in the case of which the thread take-up speed of the thread take-up device of the workstation and at least one further correction factor are taken into account. The preferred defined point in time can be selected in such a way that, no later than the point in time when the initiated interruption of the take-up of the pieced auxiliary thread occurs, the thread loop running into the accumulator navel has a predefinable size and/or length.

According to a second device aspect, the problem is solved by means of a control device for operating the open-end spinning machine, the control device being designed to generate and transmit a control command for operating the auxiliary thread take-up for the take-up of the pieced auxiliary thread with an auxiliary thread take-up speed having a speed offset, which takes into account the thread take-up speed of the thread take-up device and at least one further correction factor. The control device can preferably be a component of the open-end spinning machine, for example a component of a central control device controlling the open-end spinning machine or of a workstation control device controlling the workstation of the open-end spinning machine or of a service unit control device controlling at least one service unit. Alternatively, the control device can be an external control device independent of the open-end spinning machine, such as a higher-level control device for controlling a number of textile machines or a mobile control device, which can be coupled or capable of being coupled to the open-end spinning machine either wirelessly or by cable for transmitting the control command.

The problem is also solved, with respect to the method, by the fact that, after a step of producing a piecing by means of an auxiliary thread supplied by the service unit, there is a step of taking up the pieced auxiliary thread by means of the thread take-up device and the auxiliary thread take-up, wherein the auxiliary thread take-up, preferably with the beginning of the take-up or at least from a defined point in time before an initiated interruption of the take-up of the pieced auxiliary thread, for example by clamping the auxiliary thread in the thread path upstream of the auxiliary thread take-up, is operated at an auxiliary thread take-up speed having a speed offset which takes into account the thread take-up speed of the thread take-up device and at least one further correction factor. The defined point in time can be selected as described above. In a further preferred embodiment, such operation of the auxiliary thread take-up can take place at least until shortly before or up to the point in time of the initiated interruption, while in a yet further preferred embodiment this can also take place after the point in time of the initiated interruption, for example to dispose of the auxiliary thread. The latter embodiment offers the particular advantage that there is no need to generate and transmit a modified control command.

The dependent claims relate to advantageous configurations of the present invention.

The design, according to the invention, of the auxiliary thread take-up of a service unit offers the particular advantage that, due to the consideration of at least one further factor influencing the thread path of the pieced auxiliary thread during its take-up, in particular during its disposal, it is possible to ensure that the auxiliary thread take-up speed of the auxiliary thread take-up of the service unit is adapted to the thread take-up speed of the thread take-up device of the workstation. This means that it is possible reliably to guarantee that the thread loop entering the accumulator navel of the workstation during the disposal of the auxiliary thread does not take on such a shape or dimension that would lead to a thread break or entanglement of the thread loop. By minimising the thread loop produced during the take-up or disposal of the auxiliary thread to a predefinable size and/or length, at the latest at a point in time when the interruption of the take-up is initiated, it can furthermore be ensured that there is enough space in the accumulator navel of the workstation to accommodate, without any problems, the often relatively large thread loop of the new spinning thread, which thread loop inevitably occurs during the following work step.

According to a preferred embodiment, the at least one correction factor to be taken into account is a correction factor taking into account thread friction of the auxiliary thread or a time difference between the start of the thread take-up device and the start of the auxiliary thread take-up. In particular, during a manual or automatically generated selection or setting of the auxiliary thread take-up speed, it is preferable for a speed profile to be selected or set which is above the speed profile of the thread take-up device of the workstation in a defined manner, thus ensuring that only a relatively small thread surplus or no thread surplus at all is produced, which must be temporarily stored in the accumulator navel. The manual selection can be made via an input device which is coupled to the open-end spinning machine or the control device or can be coupled thereto wirelessly or by cable. The automatically generated selection can, for example, be made by the control device, in which case the control device can preferably be connected to a knowledge base in which speed profiles are stored in a retrievable manner. Alternatively or additionally, the control device can be designed to generate the speed profile to be selected or set or controlled, taking into account a predefined or continually (e.g. periodically, aperiodically, uninterruptedly) determined speed profile of the thread take-up device of the spinning position as well as the at least one further correction factor. Furthermore, alternatively or additionally, the control device can be designed to receive a corresponding speed profile for setting the speed profile.

In a further preferred manner, the speed offset is selected or can be set or controlled in such a way that a thread loop running into the accumulator navel of the workstation during the take-up or disposal of the pieced auxiliary thread has a defined size and/or length, the length preferably being 25 mm or less, more preferably 10 mm or less. Alternatively or in addition, it is preferred if a depth of penetration of the thread loop into the accumulator navel, which depth of penetration constitutes the size of the thread loop, is less than 10 mm, more preferably less than 5 mm. Thus, on the one hand, the length of the running-in thread loop and additionally or alternatively the depth of penetration of the thread loop into the accumulator navel can be adjusted or set according to requirements, whereby the risk of a thread break and/or entanglement of the thread loop can be minimised or, better still, prevented.

By means of such a significant reduction in the size and/or length of the thread loop running into the accumulator navel, it can preferably be ensured that, during a subsequent operation such as preferably clamping the pieced auxiliary thread, for example in the course of placing on an empty tube or in the course of splicing with an upper thread end coming from the cross-wound package, wherein a considerable amount of the new spinning thread is inevitably produced and must be temporarily stored in the accumulator navel, there is still sufficient space available in the accumulator navel for a relatively large thread loop. This means that, before the subsequent operation, in which the new spinning thread is placed on the empty tube held in the winding device of the workstation or is inserted into a splicing device for splicing and is clamped in each case, and is briefly stopped in the process although more new spinning thread is constantly being supplied by the thread take-up device of the workstation, it is ensured that by far most of the accumulator navel is always empty and can therefore temporarily store new spinning thread. After the clamping process, in the course of which the pieced auxiliary thread is separated, the auxiliary thread take-up for the disposal of the separated section of the auxiliary thread can be operated preferably with an auxiliary thread take-up speed which can be selected according to the requirements, for the safe and, if necessary, rapid disposal of the separated auxiliary thread section. Consequently, operation of the auxiliary thread take-up with the auxiliary thread take-up speed having the speed offset preferably has to be provided only until the auxiliary thread is clamped.

With respect to the method, it can be likewise reliably ensured that the size and/or length of the thread loop running into the accumulator navel of the workstation does not exceed any value that might be recognised as problematic during operation with an auxiliary thread take-up speed having the speed offset. This means that, because the auxiliary thread take-up of the service unit can be operated with an auxiliary thread take-up speed which is adapted to the present thread delivery speed or thread take-up speed of the thread take-up device of the workstation plus at least one correction factor, it is ensured that the thread loop produced during the take-up or disposal of the pieced auxiliary thread and running into the accumulator navel has a reduced size and/or length which can be selected according to the requirements.

Consequently, sufficient space can be provided in the accumulator navel of the workstation to accommodate, without any problems, the relatively large thread loop of the new spinning thread, which thread loop is created during the following operation or work step.

According to a preferred embodiment, the service unit is designed as described in detail earlier, in connection with one of the above preferred embodiments.

In a preferred embodiment of the method, the speed offset is selected or controlled in such a way that, in addition to the thread take-up speed of the thread take-up device of the workstation, additionally existing thread friction conditions and/or time differences, relating to the start of the thread take-up device of the workstation and of the auxiliary thread take-up, can be taken into account.

Particularly by taking into account the thread friction conditions, which can result from relatively high mechanical friction forces caused by multiple deflections of the auxiliary thread, which is to be taken up, around the operating elements arranged on the head element of the thread placing device, it is possible to minimise, in a relatively simple and precise manner, the size and/or length of the thread loop running into the accumulator navel of the workstation during the take-up or disposal of the auxiliary thread.

Furthermore, when setting the auxiliary thread take-up speed of the auxiliary thread take-up of the service unit or the speed offset, it is also advantageous to take into account that the thread take-up device of the workstation and the auxiliary thread take-up of the service unit do not start exactly simultaneously. Especially in connection with the transmission of start signals, it is possible for time differences to occur, which preferably can be thereby taken into account.

BRIEF DESCRIPTION OF THE DRAWINGS

Further details of the invention can be taken from the embodiment example explained below on the basis of the drawings.

In the drawings.

DESCRIPTION OF THE PREFERRED EMBODIMENTS

Figure 1:
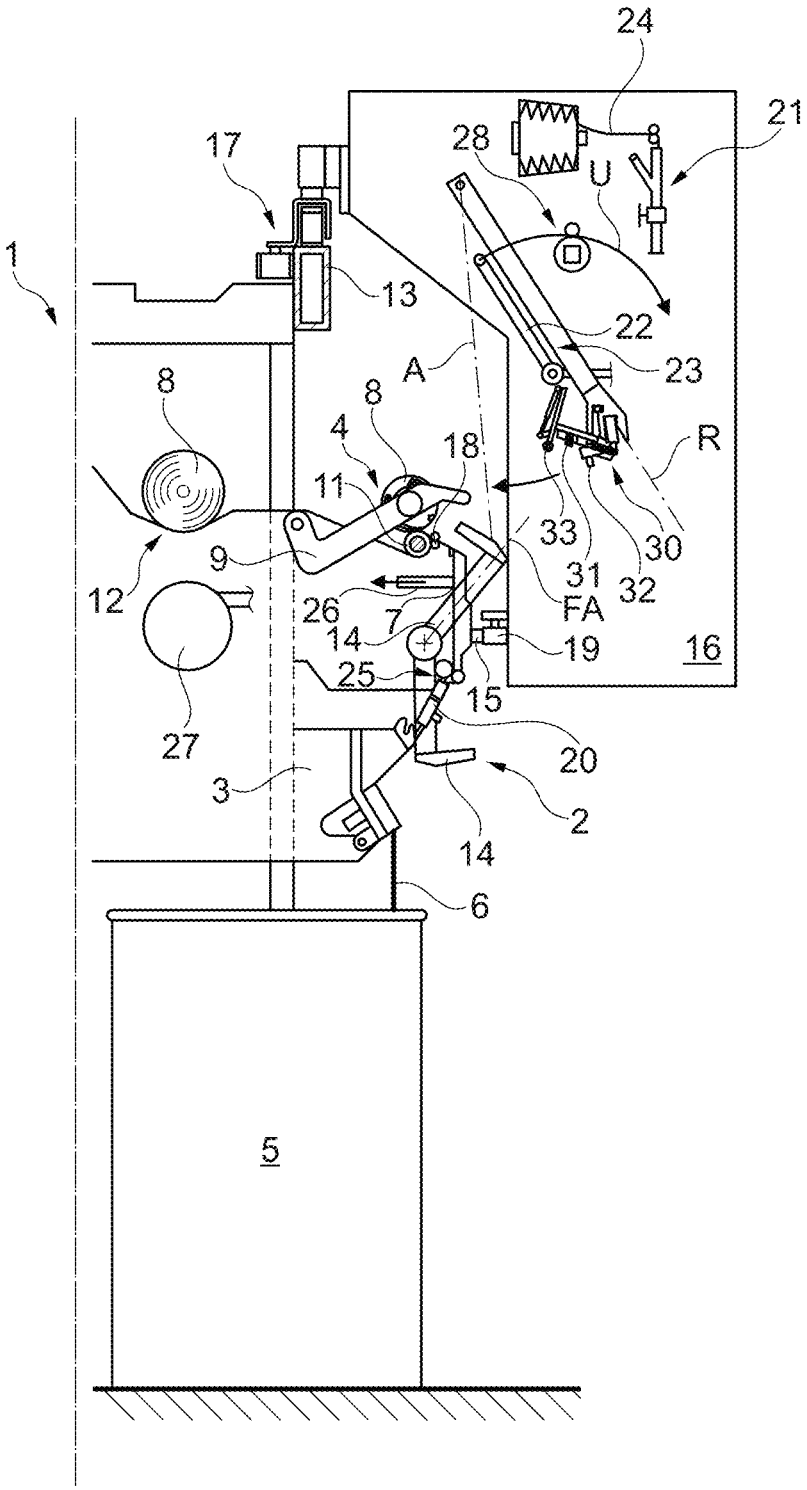
FIG. 1 shows a schematic view of one half of an open-end spinning machine, with a service unit positioned at a workstation of the open-end spinning machine, according to an embodiment example for carrying out a method according to an embodiment example.

FIG. 1 shows one half of an open-end spinning machine 1, which is designed as an air spinning machine or a rotor spinning machine, for example. Such textile machines usually have a plurality of workstations 2, each of which is equipped with, among other things, a spinning device 3 and a winding apparatus 4. In the spinning device 3, a fibre band 6 supplied in a spinning can 5 is spun into a thread 7, which is then wound into a cross-wound package 8 on the winding apparatus 4. For this purpose, the winding apparatus 4 is equipped with a package cradle 9 for rotatably holding an empty tube 10 or the sleeve of a cross-wound package 8 and with a winding drum 11 for driving these elements.

Furthermore, such workstations 2 each have a piecing tool 20 installed in the area of the spinning device 3, a thread take-up device 25, an accumulator navel 26 connected to a machine-length vacuum duct 27 of the textile machine, and a thread traversing device 18 arranged in the area of the winding device 4.

Such workstations 2 are also each equipped with their own pivotally mounted suction nozzle 14, which makes the workstations 2 into largely autonomous workstations 2. This means that the workstations 2 are equipped in such a way that they can repair thread breaks automatically if necessary.

Such open-end spinning machines 1 also often have a cross-wound package transport device 12 for the disposal of the cross-wound packages 8 finished on the winding apparatuses 4 of the workstations 2.

Furthermore, at or on the spinning machine 1, at least one service unit 16 is arranged, which can be moved on a guide rail 13 and a support rail 15, for example, and the running gear 17 of which consists of running rollers or a support wheel 19, for example.

As is known per se, such service units 16 are supplied with electrical energy preferably via a sliding-contact device (not shown) or via a trailing chain. During the spinning/winding operation of the open-end spinning machine 1, either such service units 16 patrol continuously along the workstations 2 and intervene automatically if a need for action arises at one of the workstations 2, or the service unit 16 is requested by a workstation 2 if necessary and then positions itself at the workstation 2 in question. Such a need for action exists, for example, if a cross-wound package 8 has reached a specified diameter at one of the workstations 2 and must be exchanged for a new empty tube 10. Such a need for action can also exist if a thread break has occurred which is to be remedied by means of a splicing process.

Such service units 16 are equipped with numerous handling devices in order to be able to carry out a cross-wound package/empty tube change correctly. Of these numerous handling devices, the auxiliary thread delivery device 21 with a pivotally mounted thread delivery pipe 22 is shown in FIG. 1. Furthermore, such service units 16 each have a movably mounted thread placing device 23 and an auxiliary thread take-up 28, which is preferably designed as a mechanically operating roller delivery unit. The thread delivery pipe 22 of the auxiliary thread delivery device 21 is rotatably mounted on an intermediate wall of the service unit 16 and can be controlled in a defined manner, for example by means of a stepper motor. A reserve package of the auxiliary thread delivery device 21 is connected to the thread delivery pipe 22, for example via a rotary union and a pipe system, which reserve package provides the auxiliary thread 24 required during a cross-wound package/empty tube change. In the area of the pipe system of the auxiliary thread delivery device 21, a thread cutting device is also installed, which cuts the auxiliary thread 24 as required.

The thread placing device 23 has, at an end thereof, a head element 30, which is equipped with various operating elements. The head element 30 has, for example, a thread cutting device 31, an adapter plate opener 32, a thread deflection roller 33 and a thread brake 35.

Figure 2:
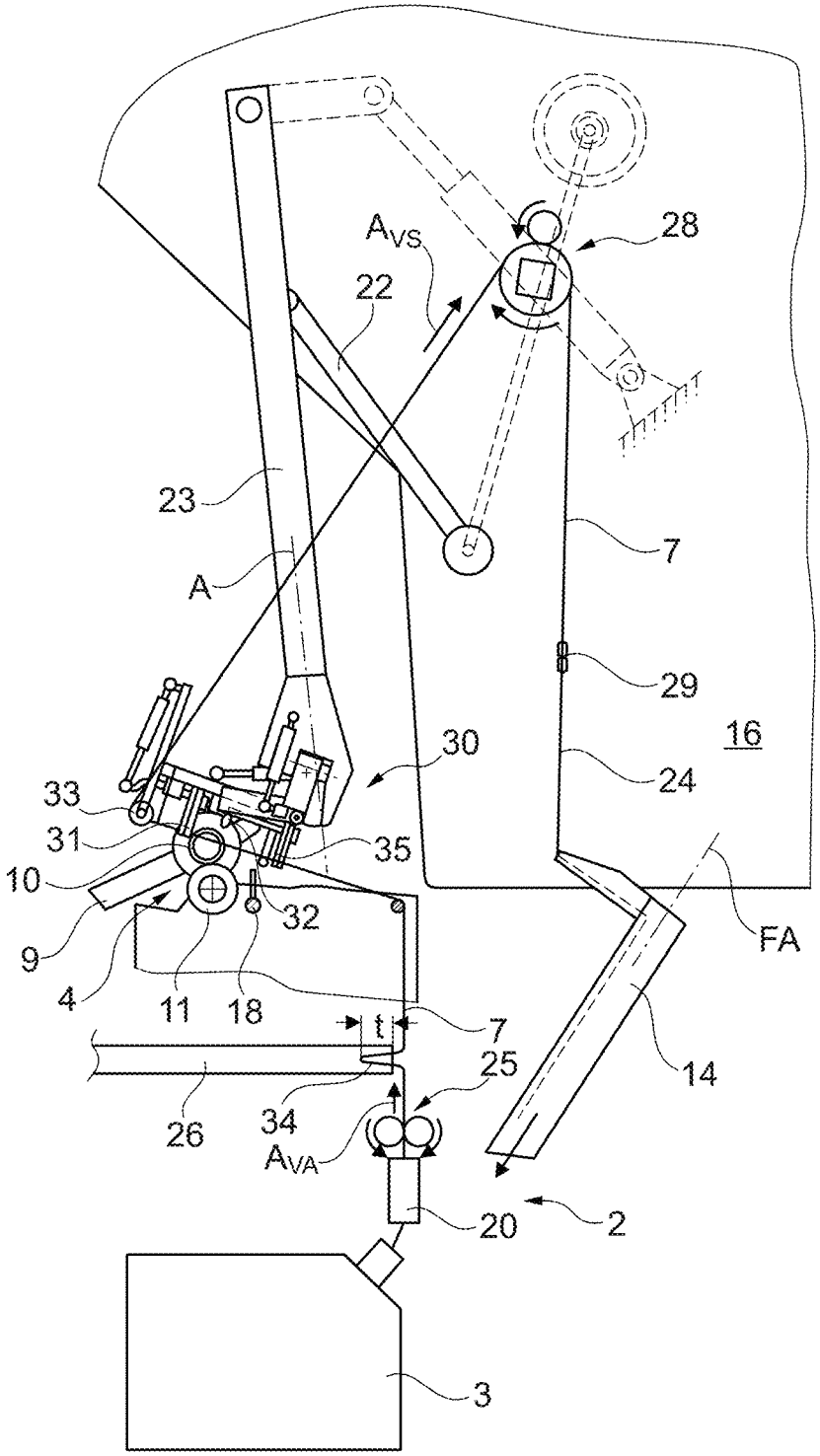
FIG. 2 shows, on a larger scale, a portion of the service unit as shown in FIG. 1 during the take-up of an auxiliary thread, which has been pieced onto a new spinning thread in the spinning device of the workstation, by the thread take-up device of the workstation and the auxiliary thread take-up of the service unit.

FIG. 2 shows, on a larger scale, a portion of a workstation 2 and a schematic view of a service unit 16 during the disposal of an auxiliary thread 24 required in connection with a cross-wound package/empty tube change.

In the spinning device 3 of the workstation 2, the auxiliary thread 24 had shortly before been placed, for example, on a fibre ring circulating in the spinning device 3 and is now being disposed of.

As can be seen, the auxiliary thread 24, which is connected to the new spinning thread 7 via what is referred to as a piecing 29, is taken up from the spinning device 3 by the thread take-up device 25 of the workstation 2 and the auxiliary thread take-up 28 of the service unit 16 and is disposed of by the pivotally mounted suction nozzle 14 of the workstation 2.

On its way to the suction nozzle 14, the auxiliary thread 24 or the new spinning thread 7 is guided by the thread placing device 23, which is in its working position A and which has, in the area of its head element 30, a thread brake 35, a thread cutting device 31 and a thread deflection roller 33, among other things. The head element 30 is also equipped with an adapter plate opener 32, which ensures that there is a gap between an end face of an empty tube 10 held in the package cradle 9 and one of the tube adapter plates of the package cradle 9, through which gap the auxiliary thread 24 or the new spinning thread 7 runs during their disposal.

The thread strand deflected at the thread deflection roller 33 then runs to the auxiliary thread take-up 28 of the service unit 16 and from there to the suction nozzle 14, which is positioned in its thread pick-up position FA.

On its way from the thread take-up device 25 of the workstation 2 to the auxiliary thread take-up 28 of the service unit 16, the thread strand also passes an accumulator navel 26 of the workstation 2, which can be subjected to a vacuum and ensures that any thread surpluses that may occur are temporarily stored.

Sequence of the method according to a preferred embodiment example:

When a cross-wound package 8 has reached its specified diameter at one of the workstations 2, the service unit 16 is ordered to the workstation 2 in question, for example by the central control unit of the open-end spinning machine 1, and there, as is known, the service unit 16 automatically replaces the full cross-wound package 8 with a new empty tube 10. This means that, after the full cross-wound package 8 has been ejected onto a cross-wound package transport device 12 running the length of the machine by appropriate handling devices (not shown), the service unit 16 inserts a new empty tube 10 between the adapter plates of the package cradle 9 of the relevant workstation 2.

Since, as is known, an auxiliary thread 24 is required for piecing up the workstation 2, the suction nozzle 14 belonging to the workstation is then swivelled into a thread pick-up position FA, as is known from the prior art, and at the same time the thread delivery pipe 22 of the auxiliary thread delivery device 21 of the service unit 16 is positioned in a thread transfer position, for example by means of a stepper motor. This means that the thread delivery pipe 22 is swivelled so far that the mouth of the thread delivery pipe 22 is positioned in front of the suction opening of the suction nozzle 14.

Subsequently, the thread delivery pipe 22, which, as explained above, is connected to an auxiliary thread delivery device 21, is pneumatically loaded in such a way that an auxiliary thread 24 emerges from the mouth of the thread delivery pipe 22 and is immediately sucked in by the suction nozzle 14, which can be subjected to a vacuum, of the workstation 2.

At this point in time, the thread placing device 23 of the service unit 16 is still positioned in its latched position R.

Finally, the thread delivery pipe 22 is swivelled into an upper operating position (not shown) and more auxiliary thread 24 is supplied accordingly by the auxiliary thread delivery device 21. During the pivoting of the thread delivery pipe 22 into the upper operating position, the auxiliary thread 24 is pulled over the thread deflection roller 33 of the thread placing device 23, which is still positioned in its latched position R at this point in time.

In the next step, the thread placing device 23 is swivelled forward into its working position A. The auxiliary thread 24 guided in the thread deflection roller 33 of the thread placing device 23 of the service unit 16 is threaded into a thread cutting device 31 arranged on the head element 30 of the thread placing device 23 as well as into a thread brake 35.

At the same time or subsequently, the suction nozzle 14, which secures the auxiliary thread 24 pneumatically, is swivelled downwards into the position shown as a dashed line in FIG. 1, threads the auxiliary thread 24 into the thread take-up device 25 of the workstation 2 and then transfers the auxiliary thread 24 to the piecing tool 20 of the workstation 2.

In a corresponding thread preparation device of the piecing tool 20, for example a pneumatically loadable preparation tube, the thread end of the auxiliary thread 24 is then prepared for the subsequent piecing process and the auxiliary thread 24 is kept ready for the piecing process by the thread take-up device 25.

Subsequently, the now free suction nozzle 14 swivels upwards again into its thread pick-up position FA.

In addition, the thread delivery pipe 22 of the auxiliary thread delivery device 21 continues to swivel clockwise in the swivel direction U and positions itself in the thread transfer position again. In the course of this swivel movement of the thread delivery pipe 22, the auxiliary thread 24 is also threaded into the auxiliary thread take-up 28 of the service unit 16.

The auxiliary thread 24 is then separated by a thread cutting device arranged inside the auxiliary thread delivery device 21, exits the mouth of the thread delivery pipe 22 due to the blowing flow prevailing in the pipe system of the auxiliary thread delivery device 21 and is immediately sucked into the suction nozzle 14 due to the vacuum prevailing in the area of the suction opening of the suction nozzle 14. This means that the auxiliary thread 24 is now tensioned between the thread take-up device 25 of the workstation 2 and the workstation's own suction nozzle 14 and runs through various operating elements of the thread placing device 23 and through the auxiliary thread take-up 28 of the service unit 16.

Then, the thread placing device 23 is actuated in such a way that it tilts one of the adapter plates of the winding device 4 slightly outwards by means of what is referred to as an adapter plate opener 32. A wedge-shaped gap is created between the adapter plate of the package cradle and the end face of the tube base of an empty tube 10 held in the package cradle 9, through which gap the thread string of the auxiliary thread 24 runs. The auxiliary thread 24 guided in the thread deflection roller 33 of the thread placing device 23 also runs through the thread cutting device 31 and the thread brake 35 of the thread placing device 23.

In order to piece up the workstation 2, a small thread length of the auxiliary thread 24 is first fed back toward the spinning device 3 by the auxiliary thread take-up 28 of the service unit 16 and is temporarily stored in the accumulator navel 26 of the workstation 2. Subsequently, an exactly defined thread length of the auxiliary thread 24, which auxiliary thread 24 has been prepared in the meantime and held ready by the piecing tool 20 of the workstation 2, is precisely fed back into the spinning device 3 by the thread take-up device 25 of the workstation 2 and is placed against a circulating fibre ring there, which is opened up in the process.

Subsequently, the auxiliary thread 24, which is now connected to the new spinning thread 7 via what is referred to as a piecing 29, is taken up by the thread take-up device 25 of the workstation 2 and the auxiliary thread take-up 28 of the service unit 16 and is disposed of by means of the suction nozzle 14 of the workstation 2.

According to a preferred embodiment example, the auxiliary thread take-up 28 of the service unit 16 is designed and can be set in such a way that the auxiliary thread take-up speed $A_{VS}$ of the auxiliary thread take-up 28 is adapted to the thread take-up speed $A_{VA}$ of the thread take-up device 25 of the workstation 2, further taking into account a correction factor which takes the thread friction into account. Both the length and a depth of penetration t of a thread loop 34 running into the accumulator navel 26 of the workstation 2 during the disposal of the auxiliary thread 24 can thus be set to an optimum, i.e. small value, which is preferably only a few mm.

As soon as the auxiliary thread 24 including piecing 29 has been disposed of by means of the suction nozzle 14, the spinning thread 7 is placed on the empty tube 10 and a transfer tail or a cross winding is wound. This means that the operating elements arranged on the head element 30 of the thread placing device 23 perform a number of quick actions one immediately after the other.

For example, the new spinning thread 7 is cut by the thread cutting device 31 at a short distance downstream of the empty tube 10 and simultaneously clamped by the thread brake 35, which is arranged a short distance upstream of the empty tube 10. The cut-off thread piece still running through the auxiliary thread take-up 28 of the service unit 16 is disposed of via the suction nozzle 14. Immediately after the thread separation, the head element 30 of the thread placing device 23 or the adapter plate opener 32 is also actuated in such a way that the adapter plate which has been tilted up to this point is closed again and the spinning thread 7 is clamped between the end face of the empty tube 10 and the adapter plate. Immediately after the thread brake 35 opens, the winding drum 11 is then started and accelerates the empty tube 10, which is in frictional contact with the winding drum 11, to winding speed. After that, the thread placing device 23 of the service unit 16 is swivelled back into its rest position R so that the spinning thread 7 is released in the area of the winding device 4 and can be taken over by the thread traversing device 18 of the workstation 2.

During some of the above processes, the new spinning thread 7 comes to a standstill in particular due to the activity of the thread brake 35 and the clamping of the spinning thread 7 between the adapter plate and the empty tube 10.

Since, however, the spinning device 3 of the workstation 2 again continuously produces spinning thread 7, which is taken up by the thread take-up device 25 of the workstation 2, a relatively large thread surplus is produced, which has to be temporarily stored in the accumulator navel 26 of the workstation 2 for a short time.

Since during the previous disposal of the auxiliary thread 24 it was ensured by optimum coordination of the thread take-up speeds of the various thread take-up devices, taking into account at least one further correction factor, that at this point in time only a very short thread length is temporarily stored in the accumulator navel 26, the accumulator navel 26 still has sufficient storage space for properly temporarily storing the thread surplus, which until now was often somewhat problematic because of its size.

According to an embodiment example that is not shown, a splicing device can be provided, which can be a component of either the open-end spinning machine or the service unit. The splicing device can be arranged close to the thread path or can be brought into the vicinity of the thread path or into a position such that the splicing channel is congruent to the thread path. Such splicing devices are common in the field of air spinning machines, for example.

In the event of a thread break, the auxiliary thread provided by the service unit is introduced into the spinning device in a corresponding manner in order to subsequently produce a piecing in a known manner, the auxiliary thread having been transferred to the processing area of the splicing device or being transferred after the piecing has been produced.

An upper thread end which has run onto the cross-wound package can be caught in a known manner, for example by means of a pivotally mounted suction nozzle, and transferred to the processing area of the splicing device. The transfer of the upper thread and the auxiliary thread into the area of the splicing device can have been coordinated with one another as required.

After the piecing has been produced, the pieced auxiliary thread or the spinning thread is preferably taken up by means of the thread take-up device and the auxiliary thread take-up until the piecing has passed the cutting device of the splicing device for the spinning thread. After passing the cutting device of the splicing device for the spinning thread, the spinning thread is clamped and cut while the spinning thread continues to be taken up by means of the thread take-up device, as a result of which the accumulator navel is filled by a thread loop running into it, and the separated section of the auxiliary thread is disposed of via the auxiliary thread take-up. The upper thread is likewise clamped and cut, the timing of the clamping and cutting of the upper thread being coordinated with the clamping and cutting of the spinning thread. The cut-off ends of both the spinning thread and the upper thread are opened and prepared in a known manner, for example by means of small holding and opening tubes of the splicing device. The opened and prepared ends are preferably brought into the splicing channel by means of a thread guide fork of the splicing device and spliced together while splicing compressed air is supplied. After the splicing process, the cross-wound package is accelerated to continue the winding at a winding speed such that the accumulator navel is emptied and the thread loop running into the accumulator navel is straightened out. As soon as the accumulator navel is emptied and the thread loop is straightened out, the winding of the cross-wound package is continued at a winding speed matched to the thread take-up speed of the thread take-up device.

According to a further embodiment example that is not shown, the auxiliary thread take-up is coupled to a control device, which is designed to generate a control command for operating the auxiliary thread take-up for taking up the pieced auxiliary thread with an auxiliary thread take-up speed having a speed offset and to transmit said control command for operating the auxiliary thread take-up, the speed offset taking into account the thread take-up speed of the thread take-up device and at least one further correction factor. The control device is, according to one embodiment example, a component of the open-end spinning machine, in particular a component of the service unit, and according to an alternative embodiment example it is designed as an external or mobile control device which is coupled to the open-end spinning machine wirelessly or by cable for the transmission of the control command.

LIST OF REFERENCE SIGNS

1 Open-end spinning machine
2 Workstation

3 Spinning device
4 Winding device
5 Spinning can
6 Fibre band
7 Thread
8 Cross-wound package
9 Package cradle
10 Empty tube
11 Winding drum
12 Cross-wound package transport device
13 Guide rail
14 Suction nozzle
15 Support rail
16 Service unit
17 Running gear
18 Thread traversing device
19 Support wheel
20 Piecing tool
21 Auxiliary thread delivery device
22 Thread delivery pipe
23 Thread placing device
24 Auxiliary thread
25 Thread take-up device
26 Accumulator navel
27 Vacuum duct
28 Auxiliary thread take-up
29 Piecing
30 Head element
31 Thread cutting device
32 Adapter plate opener
33 Thread deflection roller
34 Thread loop
35 Thread brake
FA Thread pick-up position
R Latched position
A Working position
U Swivel direction
t Depth of penetration
$A_{VS}$ Take-up speed of 28
$A_{VA}$ Take-up speed of 25

The invention claimed is:

1. An open-end spinning machine having a plurality of workstations, each of which has: a spinning device for producing a thread; a thread take-up device for taking up the thread from the spinning device; an accumulator navel for temporarily storing the taken-up thread; a winding device for producing a cross-wound package; and a suction nozzle, which can be subjected to a vacuum, the open-end spinning machine being equipped with at least one service unit, which serves several of the workstations and which has an auxiliary thread delivery device for delivering an auxiliary thread and an auxiliary thread take-up, which are used during a piecing process at a workstation to be served, characterised in that the auxiliary thread take-up is configured and is operated in such a way that the auxiliary thread take-up speed of the auxiliary thread take-up for the take-up of the pieced auxiliary thread has a speed offset, which takes into account the thread take-up speed of the thread take-up device and at least one further correction factor.

2. The open-end spinning machine according to claim 1, characterised in that the at least one further correction factor to be taken into account is a correction factor taking into account thread friction of the auxiliary thread or a time difference between the start of the thread take-up device and the start of the auxiliary thread take-up.

3. The open-end spinning machine according to claim 1, characterised in that the speed offset is selected or can be controlled in such a way that a thread loop running into the accumulator navel has a defined size and/or length.

4. The open-end spinning machine according to claim 3, characterised in that the speed offset is selected or is set or controlled in such a way that the length of the thread loop running into the accumulator navel is 25 mm or less, at least at a defined point in time of an initiated interruption of the take-up, and/or a depth of penetration of the thread loop into the accumulator navel, which depth of penetration constitutes the size of the thread loop, is less than 10 mm.

5. A control device for operating an open-end spinning machine according to claim 1, characterised in that the control device is designed to generate and transmit a control command for operating the auxiliary thread take-up for the take-up of the pieced auxiliary thread with an auxiliary thread take-up speed having a speed offset, which takes into account the thread take-up speed of the thread take-up device and at least one further correction factor.

6. The control device according to claim 5, characterised in that the control device is a component of the open-end spinning machine or is coupled to the open-end spinning machine either wirelessly or by cable for transmitting the control command.

7. A method for operating an open-end spinning machine according to claim 1, characterised in that, after producing a piecing by an auxiliary thread supplied by the service unit, there is taking up the pieced auxiliary thread by the thread take-up device and the auxiliary thread take-up, the auxiliary thread take-up being operated for taking up the pieced auxiliary thread at an auxiliary thread take-up speed having a speed offset, which takes into account the thread take-up speed of the thread take-up device and at least one further correction factor.

8. The method according to claim 7, characterised in that the speed offset is selected or controlled in such a way that a thread loop of the pieced thread, which thread loop is to be received by the accumulator navel, assumes a defined size and/or length.

9. The method according to claim 7, characterised in that the at least one further correction factor is a correction factor which takes into account the thread friction of the auxiliary thread, by which correction factor mechanical friction forces generated by thread deflection and/or thread contact and/or pneumatic friction forces caused by air friction are taken into account.

10. The method according to claim 7, characterised in that the at least one further correction factor or a further correction factor is a correction factor taking into account a time difference between the start of the thread take-up device and the start of the auxiliary thread take-up.

11. The method according to claim 7, characterised in that the auxiliary thread take-up is operated at the auxiliary thread take-up speed having the speed offset from the start of the take-up or from a defined point in time after the start of the take-up at least until clamping the auxiliary thread in the thread path upstream of the auxiliary thread take-up.

* * * * *